US005634518A

United States Patent [19]

Burgers

[11] Patent Number: 5,634,518

[45] Date of Patent: Jun. 3, 1997

[54] FULL FIN EVAPORATOR CORE

[75] Inventor: John G. Burgers, Oakville, Canada

[73] Assignee: Long Manufacturing Ltd., Canada

[21] Appl. No.: 251,516

[22] Filed: May 31, 1994

Related U.S. Application Data

[63] Continuation-in-part of PCT/CA92/00512, Nov. 25, 1992, abandoned.

[30] Foreign Application Priority Data

Nov. 29, 1991 [CA] Canada ..... 2056678

[51] Int. Cl.[6] ..... F28D 1/02

[52] U.S. Cl. ..... 165/153; 165/176; 165/175

[58] Field of Search ..... 165/153, 176, 165/178, 175

[56] References Cited

U.S. PATENT DOCUMENTS

| | | | |
|---|---|---|---|
| 2,354,865 | 8/1944 | Kucher et al. . | |
| 3,650,321 | 3/1972 | Kaltz | 165/178 X |
| 4,274,482 | 6/1981 | Sonoda | 165/176 X |
| 4,470,455 | 9/1984 | Sacca . | |
| 4,600,053 | 7/1986 | Patel et al. . | |
| 4,696,342 | 9/1987 | Yamauchi et al. . | |
| 4,723,601 | 2/1988 | Ohara et al. . | |
| 4,967,834 | 11/1990 | Tokizaki et al. | 165/176 X |
| 4,974,670 | 12/1990 | Noguchi . | |

FOREIGN PATENT DOCUMENTS

| | | | |
|---|---|---|---|
| 488572 | 12/1952 | Canada | 165/176 |
| 1264103 | 5/1961 | France . | |
| 1192623 | 10/1961 | France . | |
| 1448120 | 6/1966 | France . | |
| 2346036 | 4/1974 | Germany . | |
| 0153397 | 6/1988 | Japan | 165/153 |
| 1169884 | 11/1969 | United Kingdom | 165/175 |
| 1305464 | 1/1973 | United Kingdom . | |
| 2155167 | 9/1985 | United Kingdom . | |

*Primary Examiner*—John Rivell
*Assistant Examiner*—Christopher Atkinson
*Attorney, Agent, or Firm*—Gifford, Krass, Groh, Sprinkle, Patmore, Anderson & Citkowski, P.C.

[57] ABSTRACT

A flat plate type heat exchanger or evaporator is disclosed for use in automobile air conditioning systems. The heat exchanger includes a set of stacked plate pairs having refrigerant fluid passageways extending laterally between the plates of each plate pair while the spaces between the plate pairs define air flow passageways having fins located therein. In one aspect, fluid inlet and outlet passages are formed when differently sized tubes in adjacent plate pairs are telescoped together and subsequently brazed together to form a high surface area, fluid tight joint. The resulting fluid tight joint formed between tubes in adjacent plate pairs exhibits greater rupture resistance than that formed with drawn cup assemblies currently in use. These refrigerant fluid inlet and outlet passageways are spaced inwardly from the edges of the evaporator and extend transversely through the stack, the inlet and outlet passages being in communication with the fluid passageways.

8 Claims, 14 Drawing Sheets

FULL FIN EVAPORATOR CORE

This application is a continuation-in-part of International PCT application No. PCT/CA92/00512 with an international filing date of Nov. 25, 1992, now abandoned.

BACKGROUND OF THE INVENTION

Current heat exchangers for use in automobiles in applications such as air conditioners are well known, and are generally of the flat plate type. These flat plate type heat exchangers, or evaporators as they are sometimes called, are constructed with alternating and adjacent laterally extending fluid flow and air flow passages. The refrigerant fluid passageways are provided with a plurality of fluid flow obstructions located therein and are formed by bonding together pairs of elongate plates having dimples located therein. The plurality of fluid flow obstructions so formed act to produce a tortuous flow path in the fluid flow passageways in order to produce turbulence and to increase the contact surface area between the walls of the passageway and the refrigerant fluid in order to increase the efficiency of heat transfer from the air to the fluid.

In one type of evaporator, the refrigerant fluid inlet and outlet ports are located adjacent the ends of the elongate plates, such as in U.S. Pat. Nos. 4,470,455 (Sacca) and 4,600,053 (Patel et al.). These ports are formed from raised portions, sometimes referred to as cups, located adjacent to the end portions of each plate. The raised portions are generally circular and have a lip portion in the bottom of the cup, the edge of which defines an aperture in the bottom of the cup. When the pairs of elongate plates are joined together, the cups in each plate of the pair are in registration and define either a fluid inlet or outlet passageway transversely therethrough. The fluid entering the inlet enters the lateral fluid passageways between the plates via entrances located in these opposed cup segments.

The evaporator is assembled by joining together a plurality of these joined pairs of plates. The plate pairs are coupled to each other around the lips at the bottoms of the cups and a solid seal is formed by brazing. In this way, a multi-plate assembly is built up. An air-flow passageway exists between adjacent joined pairs of plates in which a high surface area fin is located for efficient heat exchange.

In another type of evaporator, the inlet and outlet tanks containing the fluid ports are adjacent to each other and located at one end of the evaporator, such as disclosed in U.S. Pat. No. 4,696,342 (Yamauchi et al.) and U.S. Pat. No. 4,723,601 (Ohara et al.).

A drawback of these current evaporator designs is a loss of efficiency due to the fact that the full frontal area of the evaporators is not utilized since the refrigerant inlet and outlet tank portions containing the fluid passages are arranged along the full width of one or both sides thereof. Thus, the area taken up by the tank portions precludes the presence of fins, which results in a finned area/duct area ratio significantly less than unity and typically ranging from 0.70 to 0.80.

Another drawback of these evaporators using the above-mentioned drawn cup assembly is the necessity for tight and accurate control over the relative positioning of the two plates during assembly, since a good seal between the lip portions of adjacent cups is essential to proper functioning of the evaporator. Further to this, these types of high surface area and unsupported joints have low burst strengths and are prone to rupture. This will increasingly become a significant problem as current air conditioning refrigerants containing chlorine, e.g. R-12, are replaced by environmentally safer materials. Some of these, for example R-134, operate at higher vapour pressures than current refrigerants and therefore heat exchangers utilizing said alternative refrigerants will require greater burst strengths.

GB patent specification A-1,305,464 published Jan. 31, 1973 describes a sheet metal radiator assembly for the circulation of coolant oil from and to an electrical transformer. This heat exchanger assembly is made with a number of laterally spaced, upright plate units, each constituted in its entirety by a pair of thin sheet steel srampings. This assembly has top and bottom header portions which are formed by tubular extensions at the top and bottom of the plates, these tubular extensions telescoping into one another and being braised together. In this known construction, there are no fins arranged between the plate pairs and the spacing between the plate pairs is governed by shoulders formed about the base of the inner tubular connector used to form each header.

Previous prior art heat exchanger designs comprised long, small diameter tubes fed through a flat fin array wherein the tubes made multiple, parallel passes through the fin and therefore providing full frontal area air flow. A drawback to this design is the relatively low surface area which the hot fluid comes into contact with during flow through the heat exchanger due to the fluid being constrained to move through the tubes.

Still another drawback to certain prior are air conditioning evaporators relates to refrigerant fluid residence times in various parts of the evaporators. In has been observed that the refrigerant flow rate in certain portions of prior art evaporators is reduced over others, creating dead zones or spots, in other words, areas of low flow velocity such as large header tanks. Under operating conditions in the vicinity of the compressor exit ports, the refrigerant is susceptible to chemical breakdown thereby forming strong acids such as hydrochloric and hydrofluoric acid in the presence of trace water contaminant. These acids are known to cause corrosion and have produced pinhole leaks in these low flow zones.

SUMMARY OF THE INVENTION

The subject invention provides a full fin plate type heat exchanger. In one aspect of the invention, the full fin heat exchanger includes a plurality of coupled plate pairs, each plate of the pair having a substantially planar portion and the plates of each pair being sealably coupled together, wherein the planar portions are spaced apart thereby enclosing a longitudinal flow passageway located therebetween and forming spaces between adjacent plate pairs defining lateral air passageways. The plates are each provided with at least two apertures therethrough, spaced from the peripheral edges of the plate. Each aperture in one plate is substantially in registration with an aperture in the other plate of the pair. The plates are formed with tubes peripherally encircling each aperture and extending transversely from the plates. The plurality of plate pairs are stacked together in spaced apart relationship wherein each tube extending from a plate pair is in registration with a tube extending from an adjacent plate pair to form a sealable coupling, the coupling including an overlapping portion which overlaps a portion of at least one of the tubes. The tubes of each upper plate project upwardly therefrom while the tubes of each lower plate project in the opposite transverse direction from the respective lower plate. Neither the tubes nor the plate pairs in the region of the apertures are formed with spacing means to position the tube of each upper plate with respect to the tube of the lower plate connected thereto in the axial direction of the tubes. The connected tubes enclose substantially transverse flow passageways wherein these transverse flow passageways are spaced apart and are in flow communication with the lateral flow passageways. There is included means defining an inlet port in flow communication with one of the transverse passageways, and means defining an outlet port in flow communication with another of said transverse passageways. The transverse passageways having end portions and means for closing said end portions not in flow communication with the inlet and outlet ports. Also, fins are located in the lateral air passageways, being in thermal contact with the plates and having transverse fluid passageways extending therethrough. Outer end sections of the fins are located laterally adjacent the tubes or longitudinally outwardly from the tubes. The lateral location of the outer end sections is in a direction perpendicular to the longitudinal edges of the plates.

According to another aspect of the invention, a plate type heat exchanger comprises a plurality of coupled plate pairs with each pair comprising an upper plate and a lower plate, each plate of said pair having a substantially planar portion, two longitudinal edges extending the length of the plate and two end edges joining said longitudinal edges, the plates of each pair being sealably coupled together, wherein the planar portions are spaced apart thereby enclosing a longitudinal flow passageway extending therebetween and forming spaces between adjacent plate pairs defining lateral air passageways; the plates each being provided with at least two apertures therethrough, said apertures being spaced from the peripheral edges of the plate, each aperture in one plate being substantially in registration with an aperture in said other plate in said plate pair; the plates being formed with connecting portions peripherally encircling each aperture and extending transversely from the plates; said plurality of plate pairs being stacked together in spaced apart relationship, wherein each connecting portion extending from a plate pair is connected to a connecting portion extending from an adjacent plate pair to form a sealable coupling, said connecting portions together enclosing substantially transverse flow passageways, said transverse flow passageways being spaced apart and in flow communication with the lateral flow passageways; means defining an inlet port in flow communication with one of said transverse passageways, and means defining an outlet port in flow communication with another of said transverse passageways; the transverse passageways having end portions and means for closing said end portions not in flow communication with the inlet and outlet ports; and fins located in said lateral air passageways, said fins being in thermal contact with the plates, and having transverse fluid passageways extending therethrough, characterized in that said connecting positions are tubes, said sealable coupling includes an overlapping portion which overlaps a portion of at least one of said tubes, the tubes of each upper plate project upwardly from the respective upper plate and the tubes of each lower plate project in the opposite transverse direction from the respective lower plate, said end edges of the plates are each provided with a flange member extending transversely from the planar portion thereof, said flange member provided with a curvilinear end portion adapted to overlap with a curvilinear end portion of a flange member of an adjacent plate pair, and outer end sections of said fins are located laterally adjacent said tubes or longitudinally outwardly from said tubes, the lateral location of said outer end sections being in a direction perpendicular to the longitudinal edges of the plates.

BRIEF DESCRIPTION OF THE DRAWINGS

Preferred and alternative embodiments of both the heat exchanger and methods of making components of see will now be described, by way of example only, with reference to the accompanying drawings, in which.

DETAILED DESCRIPTION OF PREFERRED EMBODIMENTS

Figure 1:
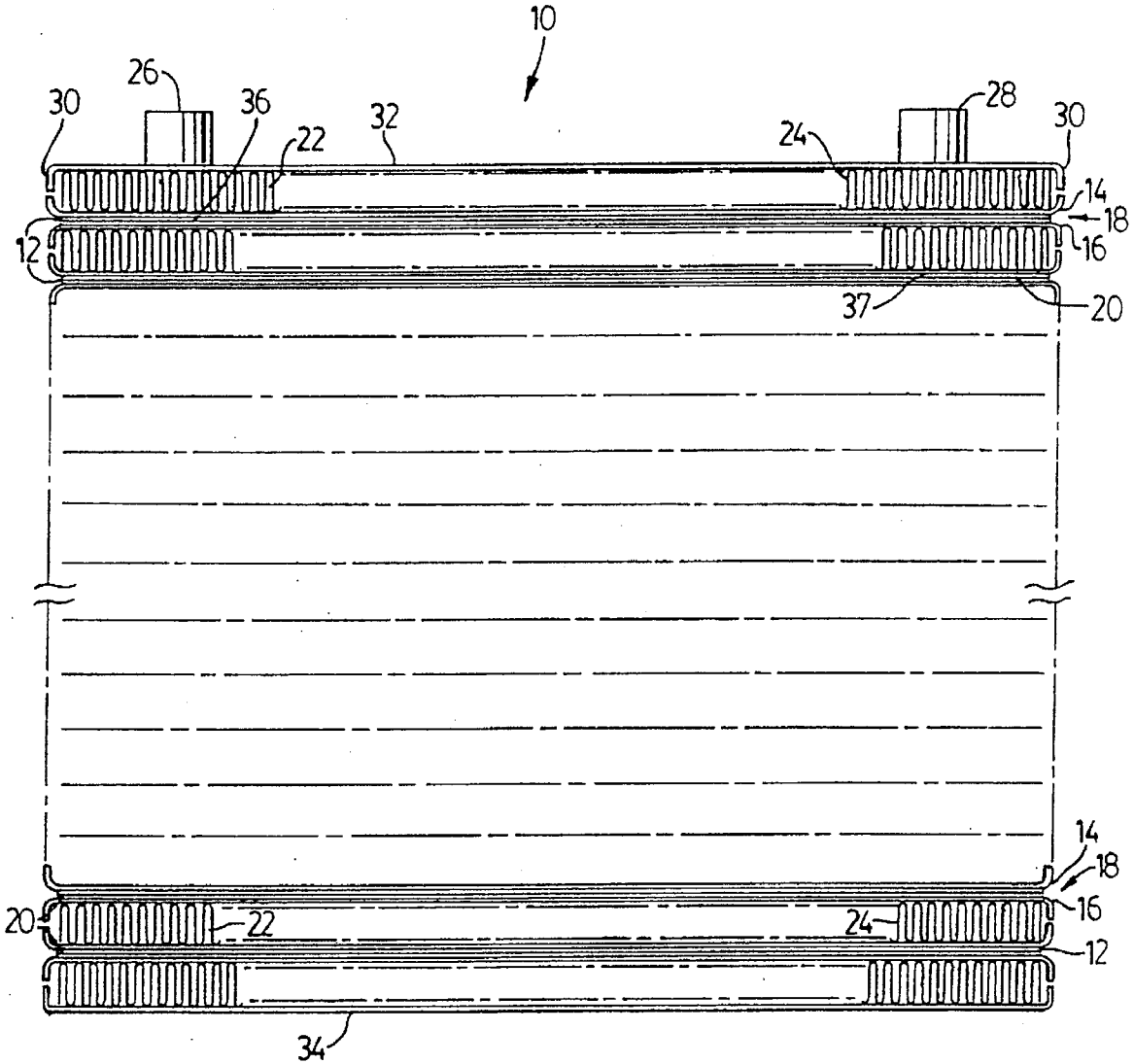
FIG. 1 is an elevational view of a preferred embodiment of a heat exchanger according to the present invention.

The structure and operation of the full fin evaporator of the subject invention will now be described, wherein like reference numerals are used throughout to refer to similar parts of different embodiments of the heat exchanger.

Figure 2:
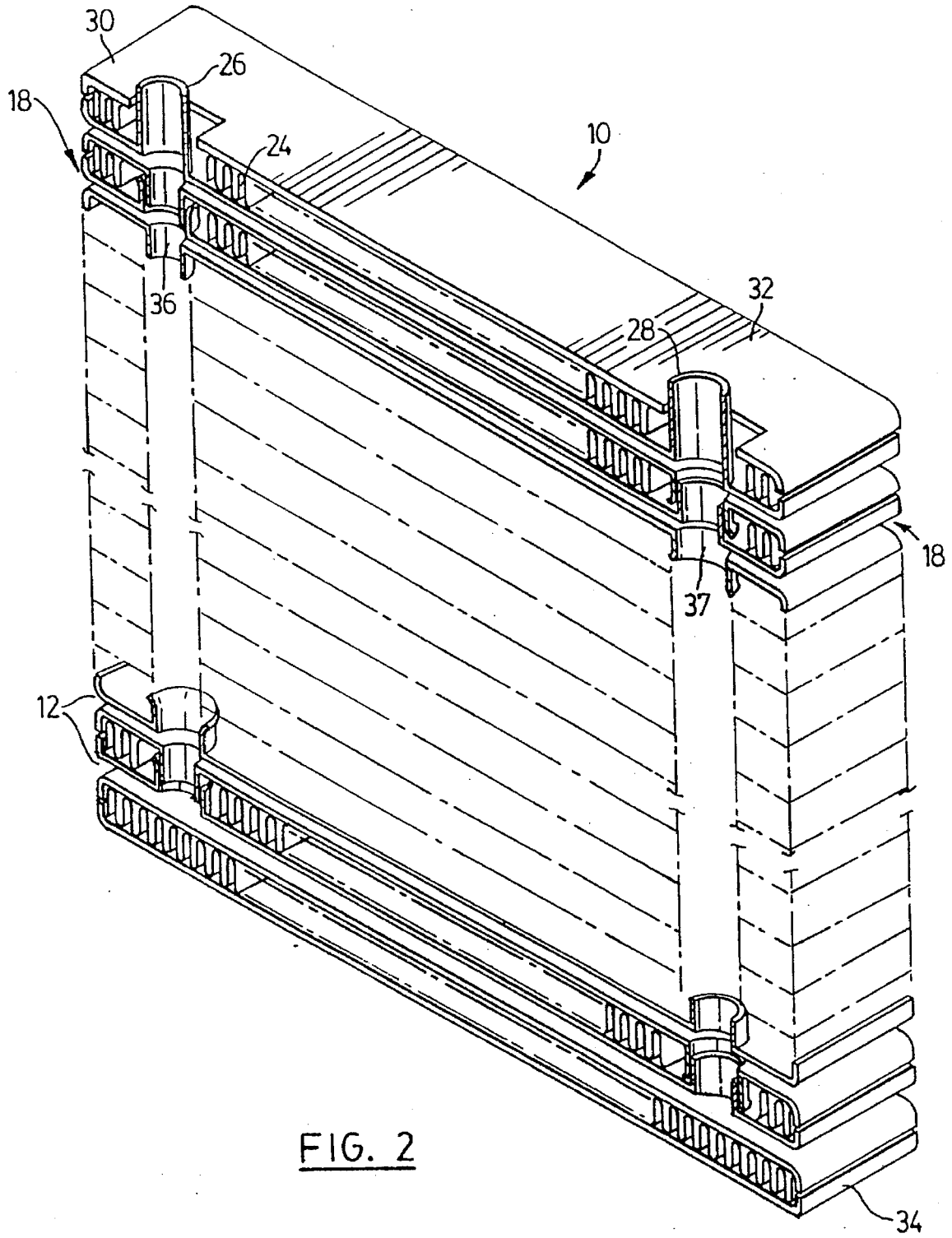
FIG. 2 is a perspective sectional view of the heat exchanger of FIG. 1.

Referring to FIGS. 1 and 2, a full fin evaporator or heat exchanger is shown generally by reference numeral 10 and includes a plurality of elongate plates 12 arranged into adjacent pairs 18, each pair comprising an upper plate 14 and a lower plate 16 sealed together in such a way as to form a refrigerant flow passageway 20 therebetween. A plurality of such plate pairs 18 are coupled in a manner to be described below to form part of heat exchanger 10. Air passages 22 are located between adjacent plate pairs 18, and fins 24 are located in air passages 22, fins 24 being in thermal contact with adjacent plate pairs 18 for providing a high surface area for heat exchange between fins 24 and air flowing through air passages 22.

Heat exchanger 10 includes a refrigerant fluid inlet port 26 and a refrigerant fluid outlet port 28 extending from the top of heat exchanger 10. Ports 26 and 28 are spaced inwardly from the end or edge portions 30 of heat exchanger 10. Heat exchanger 10 is provided with a top protective plate 32 through which pores 26 and 28 may protrude. Plate 32 is adjacent the uppermost pair of plates for protecting the uppermost fin 24 from damage. Evaporator 10 also includes a bottom protective plate 34 for protecting the bottommost fin 24 from damage in addition to providing a resting support for evaporator 10.

FIG. 2 shows heat exchanger 10 provided with a refrigerant inlet fluid passageway 36 communicating with inlet port 26, and a fluid outlet passageway 37 communicating with outlet port 28. Passageways 36,37 extend transversely through plate pairs 18 and fins 24 through the interior of heat exchanger 10.

Figure 3:
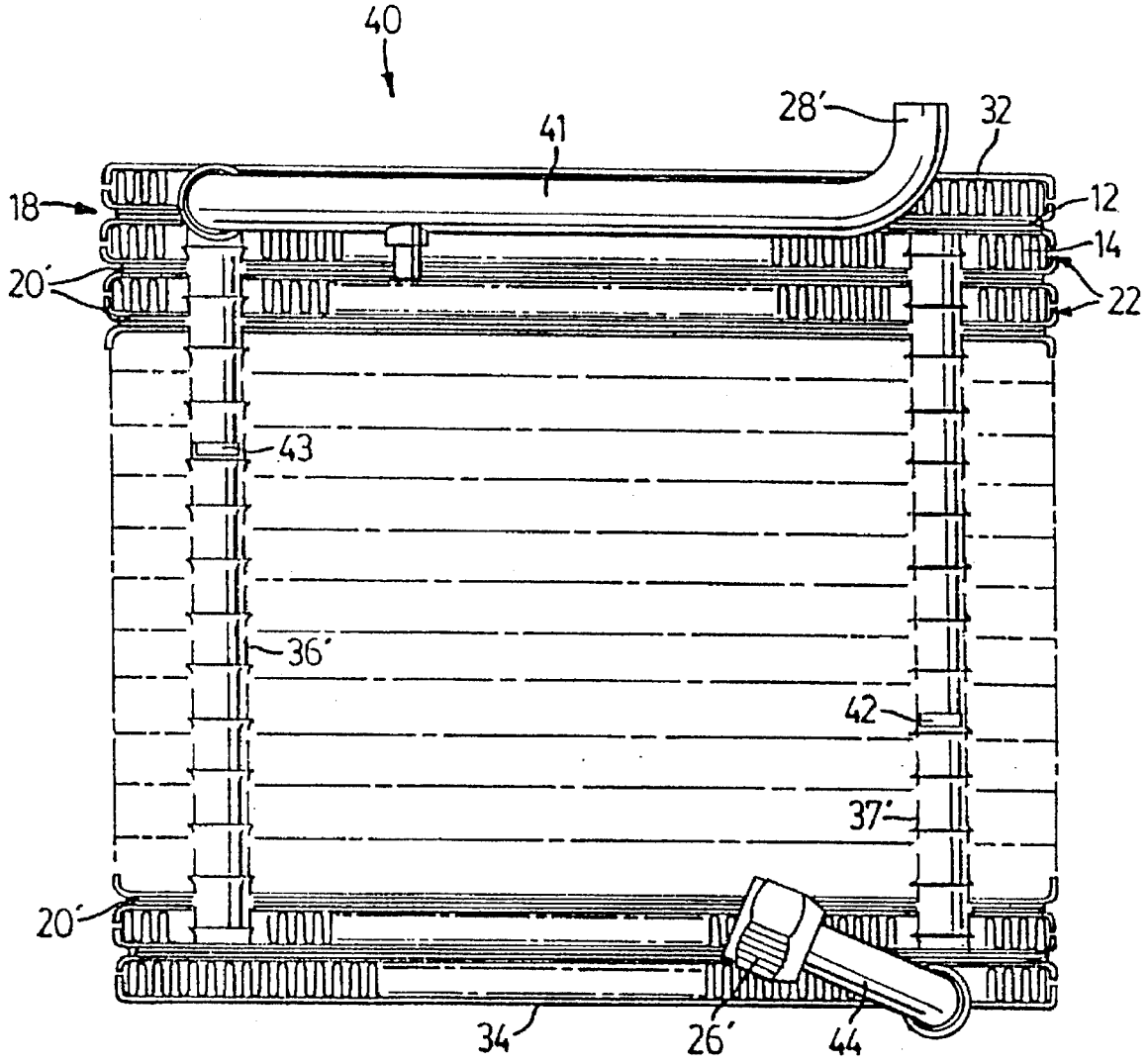
FIG. 3 is an elevational view, partly broken away of an alternative embodiment of a heat exchanger according to the present invention.

FIG. 3 illustrates another embodiment of a heat exchanger indicated generally by reference numeral 40, which is similar to heat exchanger 10, except that an inlet port 26' and an outlet port 28' are located on the same side of heat exchanger 40, but adjacent to respective bottom and top plates 34, 32. An extension tube 41 connects outlet port 28' to transverse flow passageway 36' and another extension tube 44 connects inlet port 26' to transverse flow passageway 37'. Plugs 42 and 43 are provided in fluid inlet and outlet passages 37' and 36' respectively. The purpose of plugs 42, 43 will be presently discussed.

The details of the structure and fabrication of various embodiments of plates 12 and passages 36 and 37 therethrough will now be discussed with reference to FIGS. 4 to 8.

Figure 4:
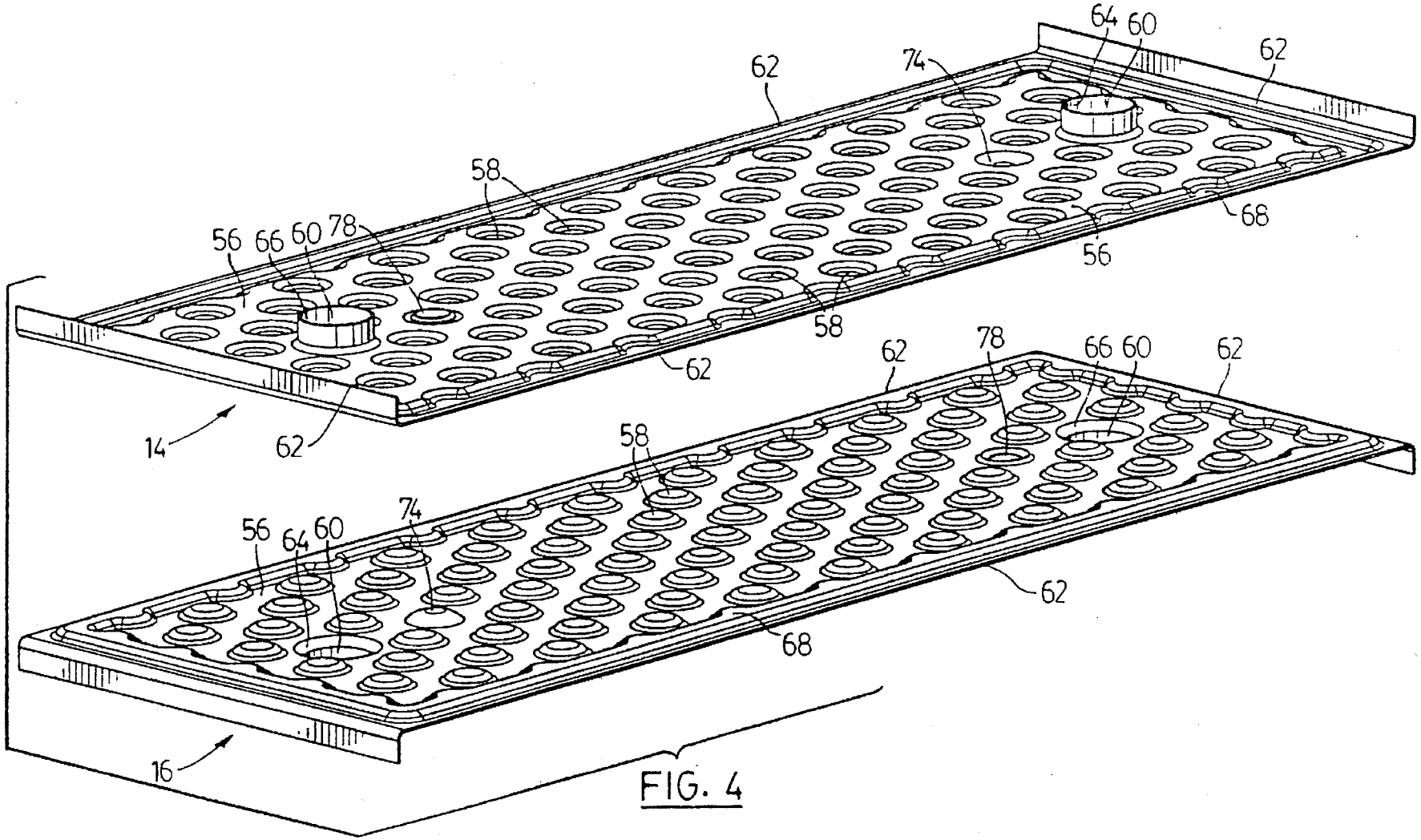
FIG. 4 is an exploded perspective view of a pair of plates which form a plate pair of the heat exchanger.
Figure 4A:
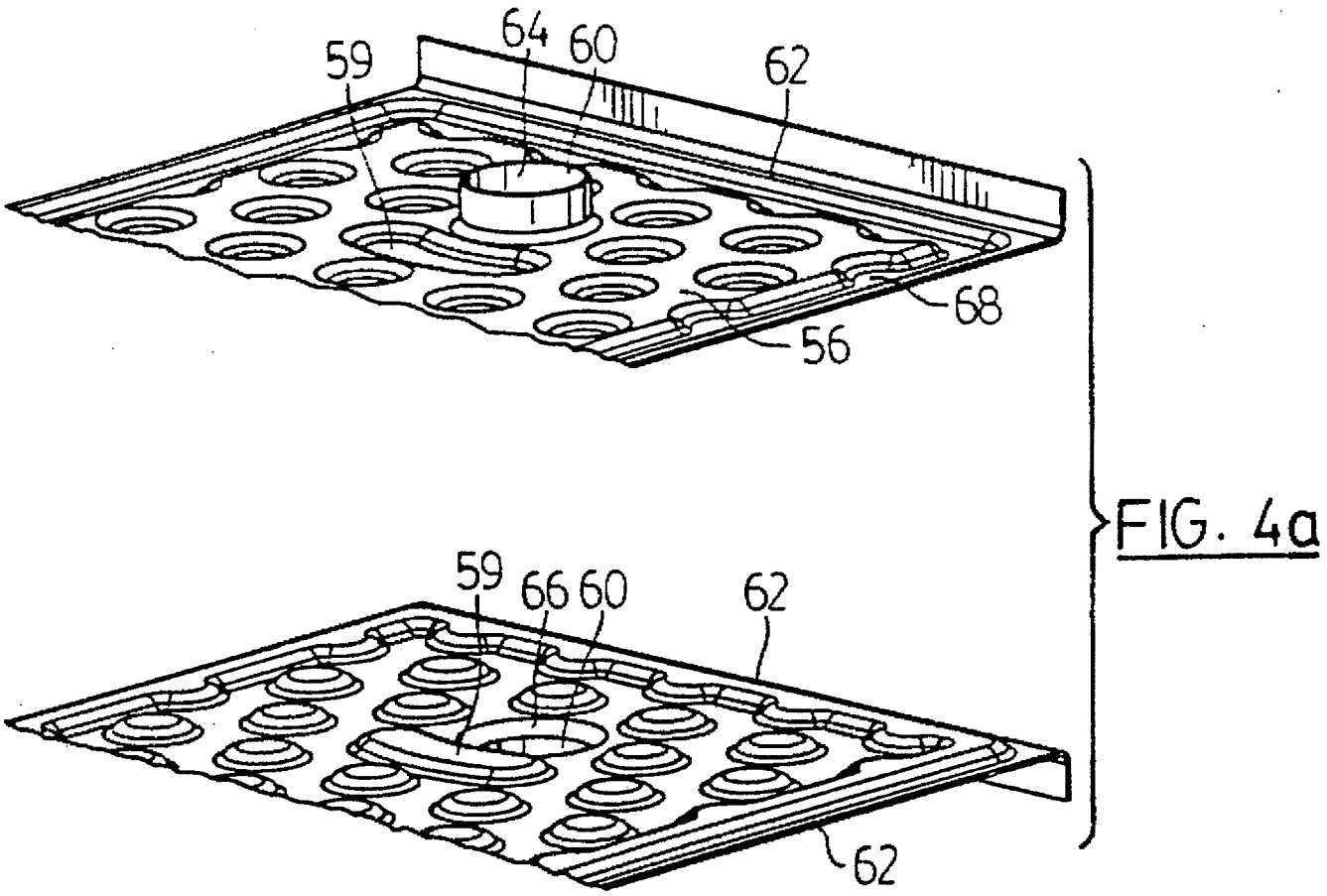
FIG. 4*a* is a scrap, exploded perspective view, similar to FIG. 4, of an alternative embodiment of heat exchanger plate.

Referring to the exploded perspective view of FIG. 4, a pair of plates 18 includes an upper or top plate 14 and a lower or bottom plate 16. Plates 14 and 16 are identical, therefore the following description applies equally to both plates. The plates 14, 16 include a central planar portion 56 and are provided with a plurality of dimples 58 uniformly spaced over each plate. Each plate includes a pair of spaced apart apertures 60 which are inwardly spaced from the peripheral or end edges 62 of the plates. The apertures 60 are spaced apart in the longitudinal direction of the plates. Pipes or tubes 64 and 66 are integrally formed or sealably attached around the peripheral edges of the respective apertures 60 and extend transversely away from the plates in the opposite direction of dimples 58. The plates include a raised edge portion 68 adjacent to peripheral edge 62, as seen best in the lower half of FIG. 4. Dimples 58 and the raised edge portion 68 extend equi-distant and transversely from planar portion 56.

Tube 64 has a diameter D1 and tube 66 has a diameter D2 wherein D1 is preferably larger than D2 by a sufficient amount such that tube 66 can be telescopingly received within a corresponding tube 64 located in another plate. In order to facilitate this telescoping arrangement, smaller diameter tube 66 may be bent radially inwards at 70 (see FIG. 5) while tube 64 is flared outwardly at 72.

Figure 6:
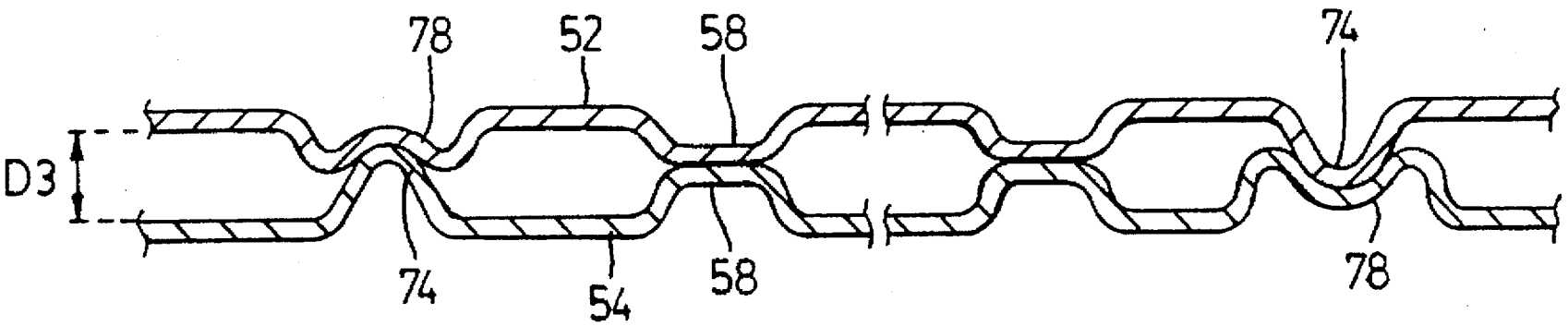
FIG. 6 is an enlarged sectional view of a portion to a plate pair showing details of the plate locating mechanism.

Referring in particular to FIG. 6, the plates 14, 16 are provided with an approximately spherical protrusion 74 located near one end and extending in the same direction as dimples 58. A spherical receptor 78 is also provided near the other end of the plate and extends in the opposite direction to protrusion 74. Protrusion 74 and receptor 78 are provided in order to prevent lateral relative movement between plates 14 and 16 during assembly of the heat exchanger. Protrusion 74 extends a distance greater than half the plate separation distance (D3) and nests within receptor 78 when the plates are compressed together, thereby preventing lateral motion between the plates. Preferably, the protrusion 74 and receptor 78 in each plate are located on a line extending between the tubes 64 and 66 as shown in FIG. 4, and each is adjacent a tube so as to provide an added flow obstruction in the flow passageway between the plates.

The plate pairs 18 are individually assembled by compressing the plates together so that the raised edge portions 68 of each plate are in registration and with the protrusions 74 in one plate nesting within the receptors 78 located in the other plate. When assembled, the plate pairs each include two pairs of concentrically aligned tubes, wherein the concentric alignment arises due to the fact that the apertures 60 in each plate are positioned to be aligned with the apertures 60 in the other plate of the pair. The tubes of each pair attached to each plate are formed having different diameters. Adjacent plate pairs are coupled together by aligning the plate pairs in such a way that the larger diameter tube in one plate is collinearly aligned with the smaller tube in the adjacent plate pair. The plate pairs are then compressed together whereby the smaller tube is telescopingly received in the larger tube, as seen in FIG. 5.

Figure 7:
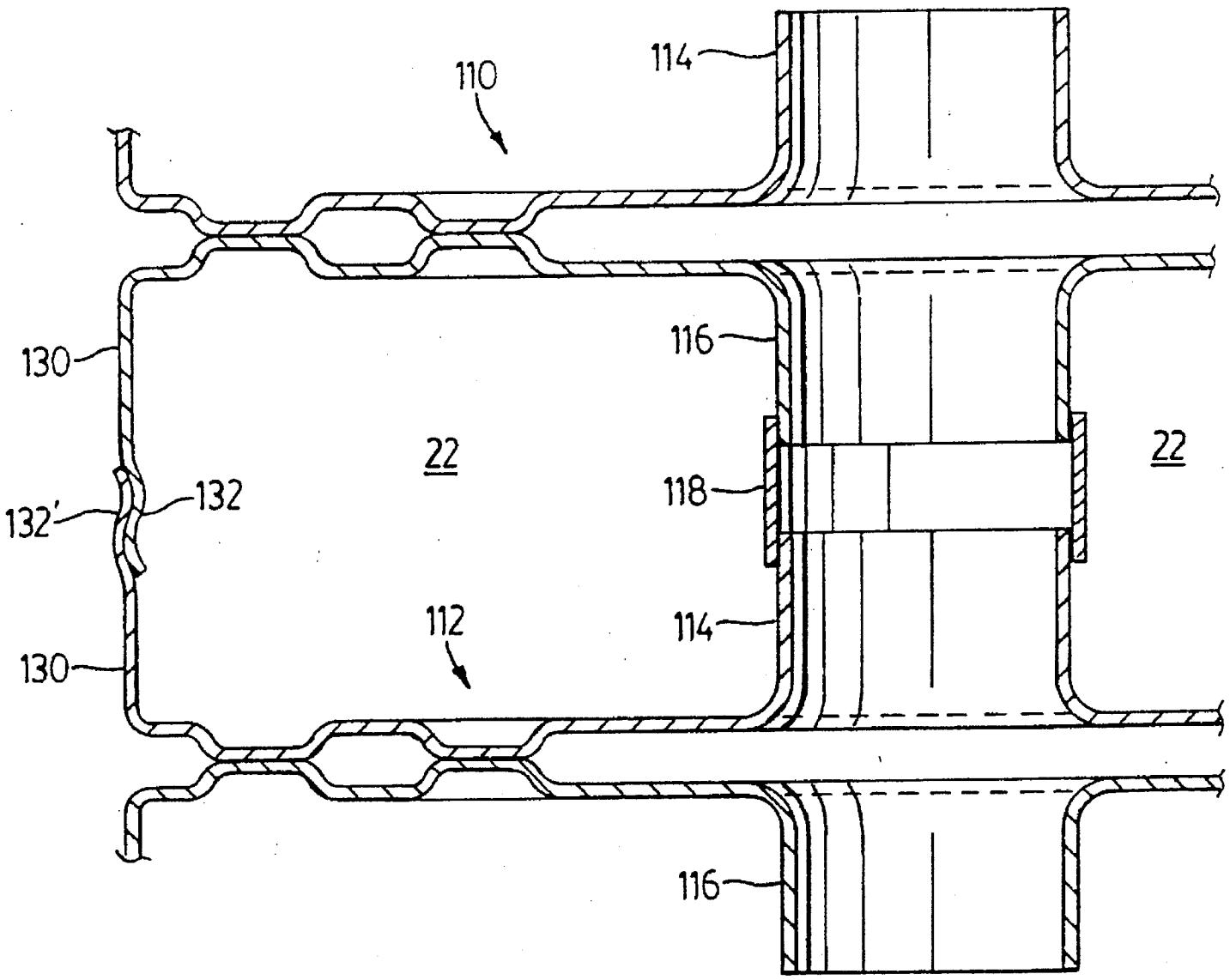
FIG. 7 illustrates an alternative method of coupling the tubes or pipes of adjacent plate pairs.
Figure 8A:
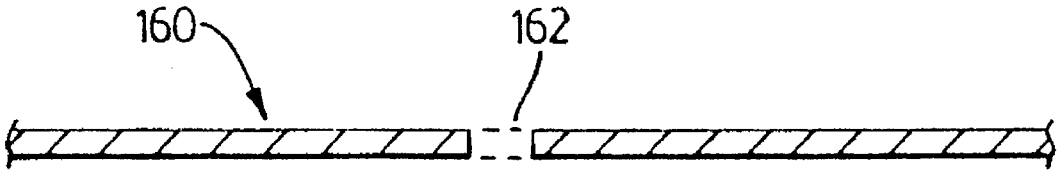
FIG. 8*a* to 8*d* are sectional views illustrating the steps in the process of piercing and stretching a plate to form the tubes therein.
Figure 8B:
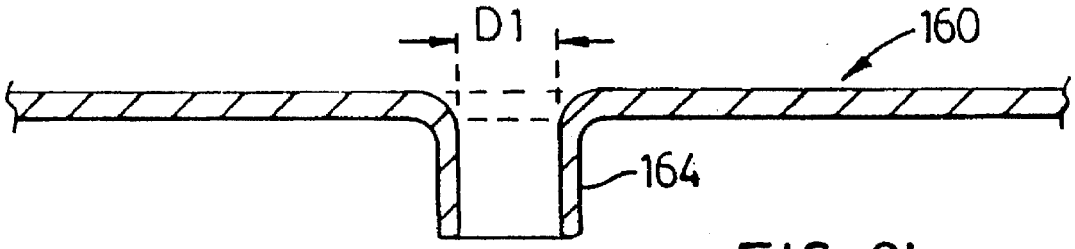
Figure 8C:
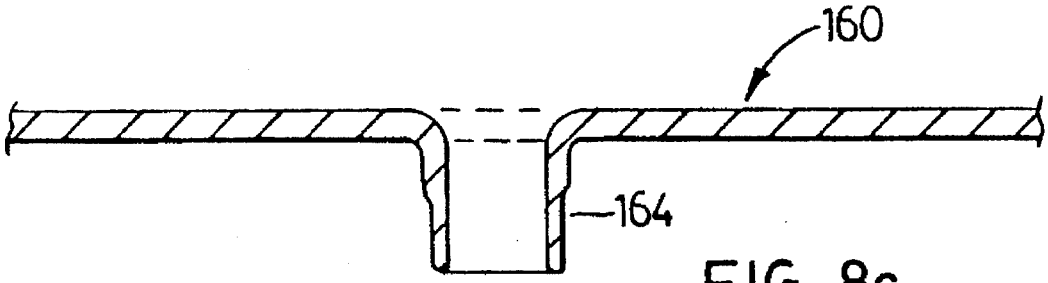
Figure 8D:
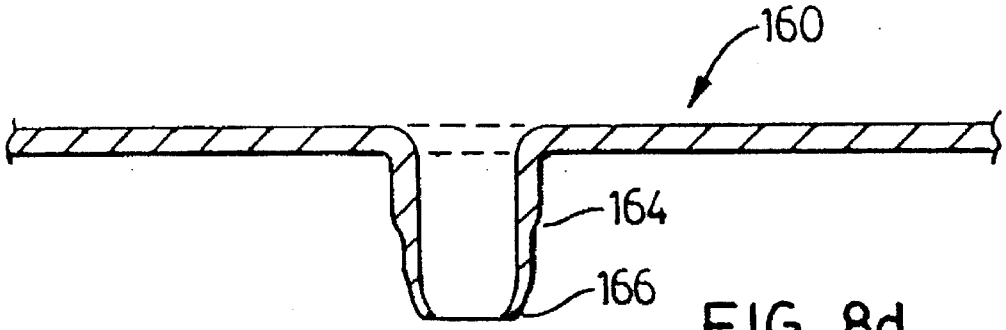

FIG. 7 shows an alternative plate design and method of coupling the pipes or tubes between adjacent plate pairs such as plate pairs 110 and 112. Tubes 114 and 116 are fabricated having the same diameter and with a length short enough so that they do not overlap when assembled to form the heat exchanger core. In this coupling arrangement, when the plate pairs 110 and 112 are assembled, tubes 116 and 114 are inserted through a collar or retainer ring 118. When the entire heat exchanger is fully assembled and brazed, a fluid tight joint is formed between collar 118 and tubes 116 and 114.

Figure 5:
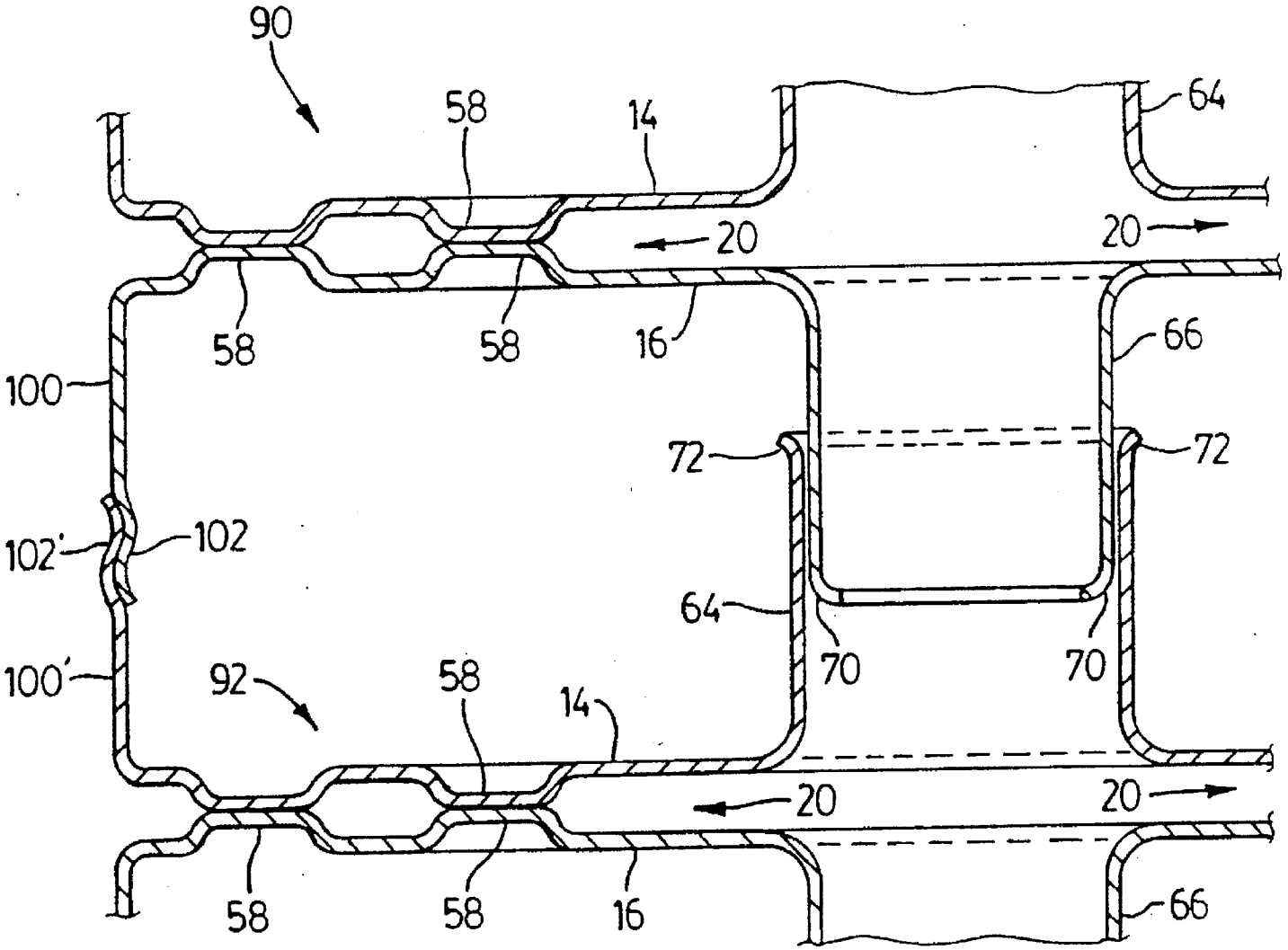
FIG. 5 is an enlarged sectional, elevational view of a portion of a plate pair.

As shown in FIGS. 5 and 7, neither the tubes 64, 66, 114, 116 nor the plate pairs 18 in the region of the apertures are formed with spacing means or devices to position the tube 64, 114 of each upper plate with respect to the tube of the lower plate 16 connected thereto in the axial direction of the tubes. The absence of such spacing means is advantageous in the construction and assembly of the heat exchanger because it helps ensure that the distance between adjacent plate pairs in the heat exchanger will correspond to the height of the fins used. A stronger, more robust heat exchanger is achieved by relying upon the fins to properly space the plate pairs. By omitting such spacing means, the assembly is less sensitive to relational height variability between spacing abutments (as used in the aforementioned U.K. patent A-1,305,464) or between cups forming the inlet and outlet manifolds (see U.S. Pat. No. 4,270,455) and the fin height. In the present heat exchanger, the plate pairs are only spaced by the fins since both the tubes and the plate ends will allow some vertical translation during braising. This assures a good contact for braising and connecting purposes between the fins and the adjacent plate pairs.

FIGS. 5 and 7 also illustrate an alternative plate arrangement wherein the peripheral end portions of the plates include transversely extending flange members 100, 130 having curvilinear end portions 102,132. When plate pairs 90, 92 and 110,112 are coupled together, respective curvilinear portions 102, 102' and 132, 132' overlap thereby helping to hold the plate pairs together while also eliminating sharp edges. These overlapping flanges also partially define the limits of the air-flow passageway 22.

In another embodiment of the heat exchanger embodying the subject invention, directional ribs (not shown) may be provided in place of dimples 58 at the end portions of the plate pairs near apertures 60 to ensure flow of the refrigerant fluid out of the end portions.

It will be readily apparent to those skilled in the art that more than one fluid inlet or exit passageway may be fabricated in the heat exchangers by forming more than one tube 64 or 66 at each end of the plate.

FIGS. 8*a* to 8*d* are sectional views that illustrate one method of forming the pipe or tube portions 64, 66 in a plate 160. FIG. 8*a* to 8*d* show a preferred fabrication technique employing a pierce and stretch method wherein plate 160 is first pierced at 162 (FIG. 8*a*) corresponding to a preferred location of a tube. The plate is then stretched in the vicinity of hole 162 (FIG. 8*b*) to form a tube 164 having a diameter D1. If required, pipe or tube portion 164 may be lengthened in an ironing operation (FIG. 8*c*) if the desired length was not achieved in the stretching step. The end portions of the small diameter tubes are bent radially inwards as shown at 166, see FIG. 8*d*, while the end portions of the larger diameter pipes are flared outwardly (not shown).

The diameter of pipe or tube 164 is preferably in the range of 0.6 to 2 cm (¼ to ¾ inches), in order to maintain substantial flow rates through the heat exchanger, thereby minimizing the probability of the formation of dead zones or regions having low flow rates.

Figure 9A:
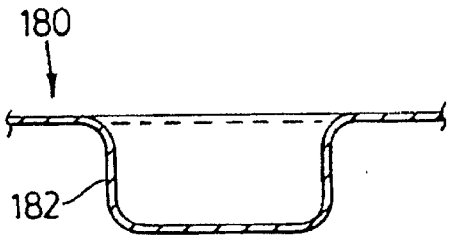
FIG. 9*a* to 9*g* are sectional views illustrating an alternative process of forming the tubes by a drawing and piercing operation.
Figure 9B:
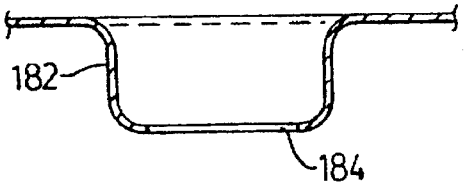
Figure 9C:
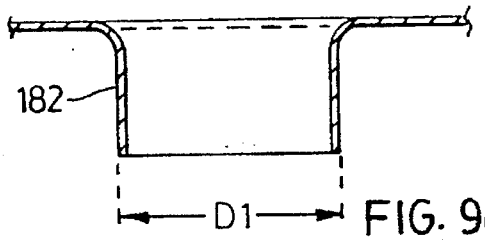
Figure 9D:
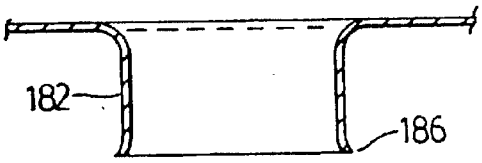
Figure 9E:
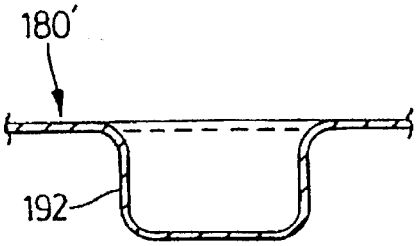
Figure 9F:
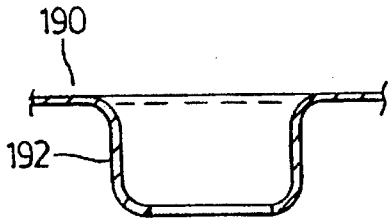
Figure 9G:
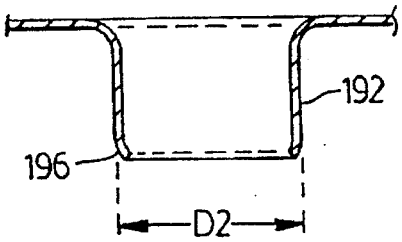

FIG. 9 shows an alternative method of forming the tube portions in a place 180 which comprises first a drawing step whereby a closed pipe portion 182 is formed by a known drawing operation, FIG. 9*a*, followed by a piercing operation to produce an aperture 184, see FIG. 9*b*, which in turn is followed by an ironing step to straighten and lengthen pipe portion 182 as illustrated in FIG. 9*c*. Pipe 182 has an outer diameter of D1. Another tube 192 is formed in plate 180 in the same way, FIG. 9*e* to 9*g*, but having a smaller diameter of D2. Those pipe portions with the larger diameters have their end portions flared outwardly as shown at 186 in FIG. 9*d*, while the end portions of the smaller diameter pipes are bent radially inwards as shown at 196 in FIG. 9*g*.

Figure 10A:
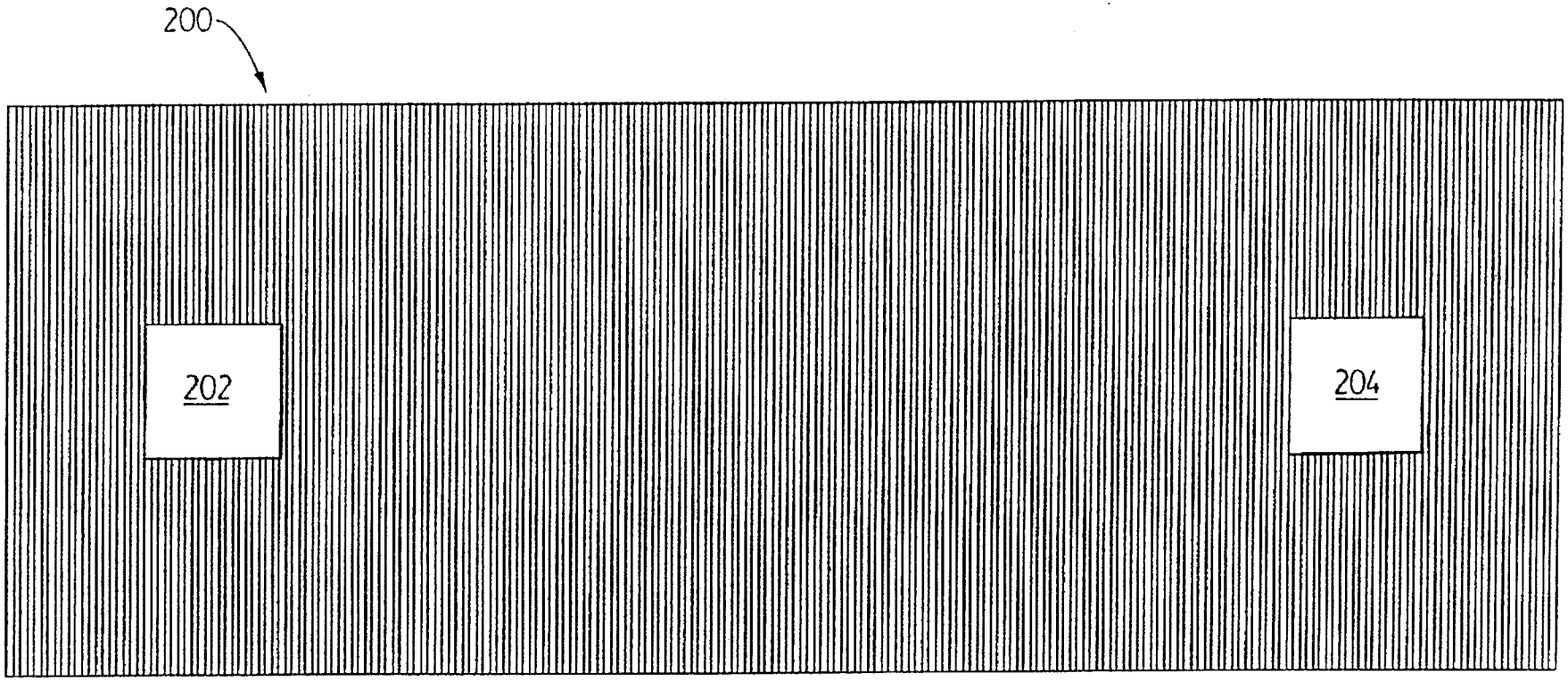
FIG. 10*a*, 10*b* and 10*c* illustrate preferred embodiments of the fin which may be used in the heat exchanger.
Figure 10B:
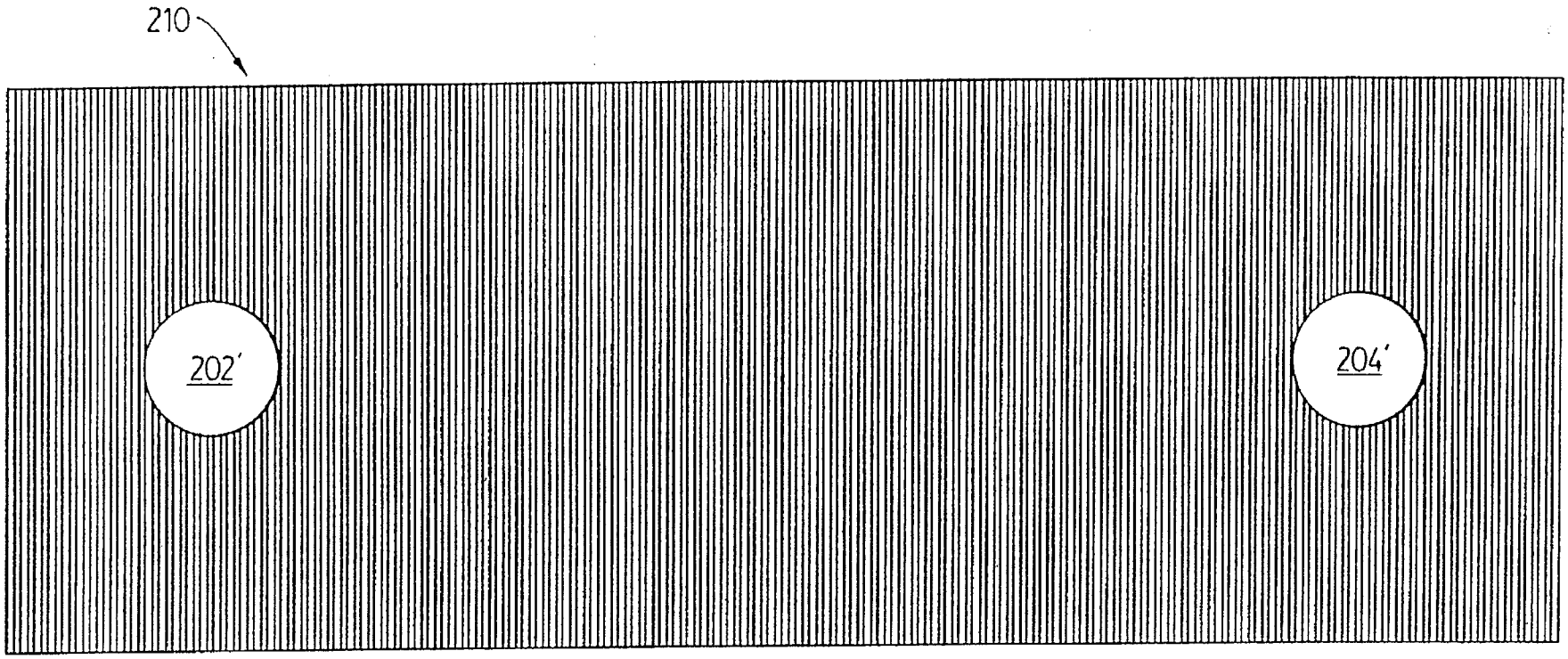
Figure 10C:
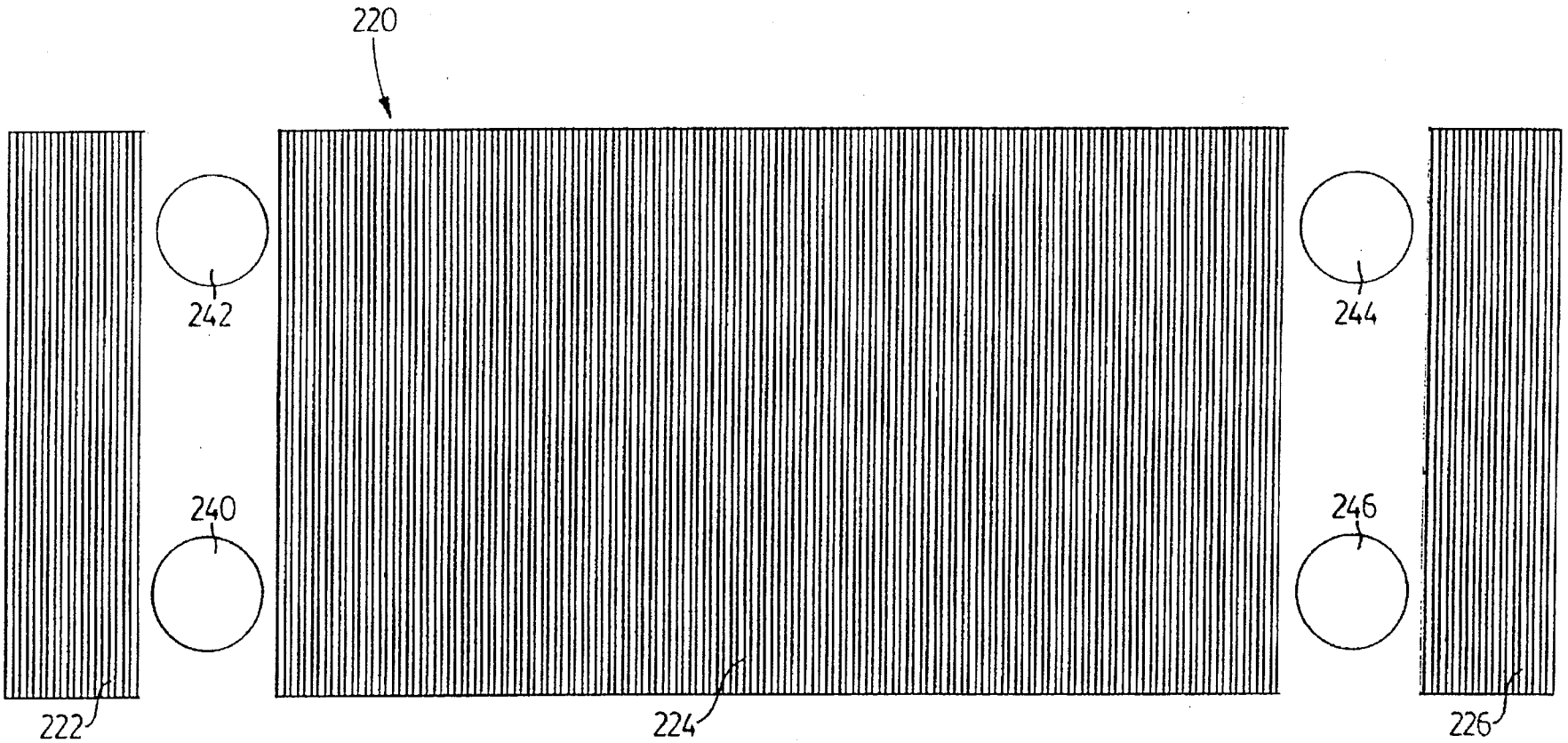

Several fin designs may be employed to accommodate the refrigerant fluid inlet and outlet conduits extending therethrough. FIGS. 10*a* to 10*c* are side views of fins showing several such designs. FIG. 10*a* shows a preferred configuration wherein a fin 200 having essentially the same planar dimensions as the plates is provided with two rectangular apertures at 202 and 204 for the tubes forming flow passageways 36, 37. Apertures 202 and 204 may be cut by laser cutting, water jet machining or electrochemical machining just to mention a few.

FIG. 10*b* illustrates another fin at 210 where apertures 202' and 204' are circular holes.

FIG. 10*c* illustrates another possible fin configuration wherein a fin 220 is comprised of three generally rectangular portions 222, 224 and 226. Multiple inlets and outlets may be employed with FIG. 10*c* illustrating two inlets 240 and 242 and two outlets at 244 and 246. It will be noted that with the fin configurations illustrated in FIGS. 10*a* to 10*c*, there are outer end sections of the fins that are longutudinally outwardly from the tubes on the sides thereof located away from the longitudinal center of the adjacent plates.

Figure 11:
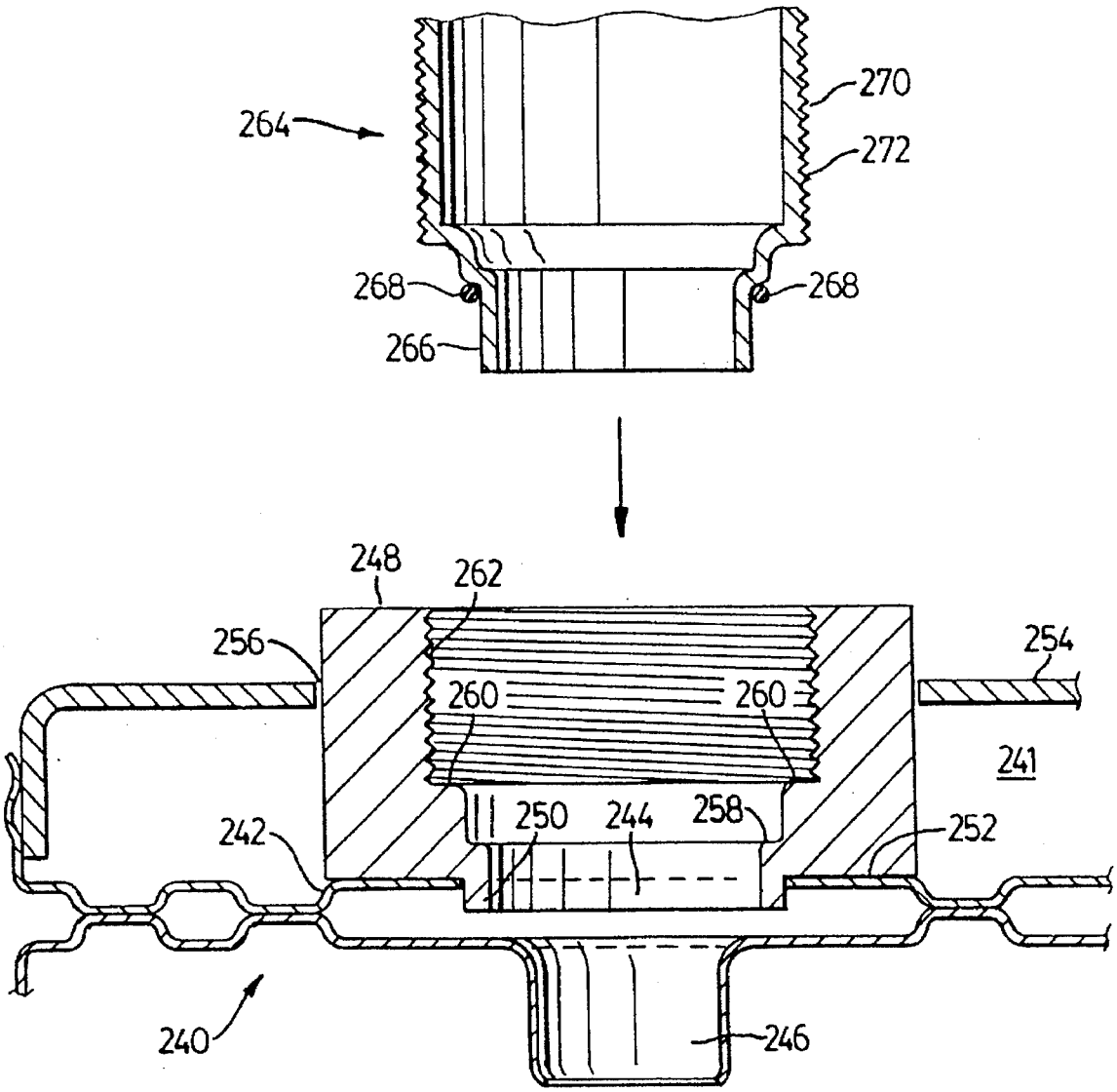
FIG. 11 illustrates the details of the coupling connection between the fluid inlet and outlet passages and associated hose coupling.

Referring to FIG. 11, the details of one embodiment of the fluid inlet and outlet connections to the heat exchanger of the subject invention are illustrated. An outer plate pair shown at 240 comprises a top plate 242 provided with an aperture at 244 which is concentric with a fluid inlet passageway 246. A fitting 248 is provided having a lip portion 250 adapted to fit through aperture 244. Fitting 248 includes a surface 252 which rests against a portion of top plate 242. A protective retainer plate shown at 254 is located adjacent to and spaced from outermost plate pair 240 to define an outermost air passageway 241 and a fin 24 (not shown) is located in passageway 241. A similar construction is used at the bottom of the heat exchanger. Retainer plates 254 are provided with apertures 256 through which a fitting 248 is inserted. During the brazing step of the assembly of the heat exchanger, fitting 248 is bonded to plate 242 by means of a brazing joint. Fitting 248 is provided with a first internal shoulder at 258 and a second internal shoulder at 260. A standard internal thread is provided at 262. A refrigerant fluid hose 264 includes a narrow portion 266 around which an O-ring 268 fits, and a wider portion 270 provided with an external thread 272 matched with internal thread 262. Hose 264 is threaded into fitting 248 until O-ring 268 is compressed against shoulder 258 thereby sealing hose 264 and fitting 248. A similar hose and fitting assembly may be utilized for the other fluid port connection (not shown).

The heat exchanger of the subject invention may be assembled by first assembling the individual plate pairs followed by building up the evaporator core by sandwiching the fins between adjacent plate pairs. For the embodiment illustrated in FIG. 5 utilizing the differently sized tubes, once the adjacent plate pairs are assembled, an expanding operation may be carried out whereby the inner tubes are expanded outwardly against the outer tube to form an intimate physical connection therebetween. If the tubes are of the same diameter, then collars may be used as shown in the embodiment of FIG. 7. With the top and bottom retainer plates in place, the entire evaporator is clamped together and the resulting assembly is then inserted into a brazing oven and heated to the appropriate temperature to accomplish brazing, all of the plates being formed of brazing clad aluminium or similar furnace brazing materials, as will be appreciated by those skilled in the art.

The operation of the heat exchanger enclosed herein will be described with reference to the embodiments illustrated in FIGS. 1 and 3. With the refrigerant fluid inlet and outlet hoses (not shown) connected to the evaporator inlet and outlet ports, 26 and 28 respectively, refrigerant fluid enters evaporator 10 via inlet passage 36 and flows laterally through flow passageways 20 in a non-linear route to outlet passageway 37. Simultaneously, as air passes through fins 24 in air passageways 22, said air is cooled via heat transfer from the fins to the refrigerant fluid. Due to the judicious choice of pipe diameter, the rate of fluid flow through outlet passageway 37 remains above a threshold value, thereby avoiding the problem of dead zones being formed.

In the evaporator design of FIG. 1, the refrigerant fluid flows into and out of evaporator 10 via transverse passageways 36 and 37 respectively and between the latter via lateral flow passageways 20.

In the alternative arrangement shown in FIG. 3, evaporator 40 is designed to produce multiple passes by the fluid due to the presence of plugs 42 and 43 strategically positioned in passages 36' and 37'. Thus fluid entering passageway 37' via inlet port 26' flows up to plug 42 and laterally through passages 20' located in the plate pairs below plug 42, and upon reaching passage 36' flows up as far as plug 43 and laterally through passages 20' located below plug 43 to passageway 37' where the fluid again rises and flows laterally through passages 20' located above plug 43 to exit port 28'.

While the present invention has been described and illustrated with respect to the preferred and alternative embodiments, it will be appreciated that numerous variations of these embodiments may be made without departing from the scope of the invention, which is defined in the appended claims.

I therefore claim:

1. A plate type heat exchanger, comprising:

a plurality of coupled plate pairs with each pair comprising an upper plate and a lower plate, each plate of said pair having a substantially planar portion, two longitudinal edges extending the length of the plate and two end edges joining said longitudinal edges, the plates of each pair being sealably coupled together, wherein the planar portions are spaced apart thereby enclosing a longitudinal flow passageway extending therebetween and forming spaces between adjacent plate pairs defining lateral air passageways;

the plates each being provided with at least two apertures therethrough, said apertures being spaced apart in the longitudinal direction of the plate and spaced from the end edges of the plate, each aperture in one plate being substantially in registration with an aperture in said other plate in said plate pair;

the plates being formed with connecting portions peripherally encircling each aperture and extending transversely from the plates;

said plurality of plate pairs being stacked together in spaced apart relationship, wherein each connecting portion extending from a plate pair is connected to a connecting portion extending from an adjacent plate pair to form a sealable coupling, said connecting portions together enclosing substantially transverse flow passageways, said transverse flow passageways being spaced apart and in flow communication with the lateral flow passageways;

means defining an inlet port in flow communication with one of said transverse passageways, and means defining an outlet port in flow communication with another of said transverse passageways;

the transverse passageways having end portions and means for closing said end portions not in flow communication with the inlet and outlet ports; and fins located in said lateral air passageways, said fins being in thermal contact with the plates, and having transverse fluid passageways extending therethrough, wherein said connecting portions are tubes, said sealable coupling includes an overlapping portion which overlaps a portion of at least one of said tubes, the tubes of each upper plate project upwardly from the respective upper plate and tubes of each lower plate project in the opposite transverse direction from the respective lower plate, neither said tubes nor said plate pairs in the region of said apertures being formed with spacing means to position the tube of each upper plate with respect to the tube of the lower plate connected thereto in the axial direction of the tubes and outer end sections of said fins are located laterally adjacent said tubes or longitudinally outwardly from said tubes on the sides thereof located away from the longitudinal center of the adjacent plates, the lateral location of said outer end sections being in a direction perpendicular to the longitudinal edges of the plates.

2. A plate type heat exchanger according to claim 1 wherein the sealable coupling includes a collar and wherein end portions of the tubes are sealably inserted each into one end of said collar.

3. A plate type heat exchanger according to claim 1 wherein the tubes coupled respectively to each plate are of a first and second diameter, the second diameter being smaller than the first diameter such that the second diameter tube is sealably receivable by the first diameter tube for forming the sealable coupling.

4. A heat exchanger according to claim 1 wherein the stack of plate pairs includes outermost plate pairs, and further comprising retainer plates located adjacent to and spaced from the outermost plate pairs, the space between the retaining plates and the outermost plate pairs defining outermost air passageways, and fins located in said outermost air passageways and in thermal contact with said retaining plates.

5. A heat exchanger according to claim 1 wherein the plates are each provided with plate locating means comprising at least one protrusion, and at least one receptor spaced from said protrusion, wherein a protrusion in one plate of a plate pair is receivable by a receptor in the other plate of said plate pair for providing at least two interlocking connections between said plates in said plate pair.

6. A heat exchanger as claimed in claim 1 wherein the plates are formed with two pairs of apertures and two pairs of tubes, one of said pairs of apertures and tubes being spaced from one end of each plate and the second pair of apertures and tubes being spaced from the opposite end of each plate.

7. A heat exchanger according to claim 3 wherein the plate pairs are spaced apart by said fins after assembly of said plate pairs and fins so that the distance between adjacent plate pairs in the heat exchanger corresponds to the height of the fin positioned between the respective adjacent plate pairs.

8. A plate type heat exchanger, comprising:

a plurality of coupled plate pairs with each pair comprising an upper plate and a lower plate, each plate of said pair having a substantially planar portion, two longitudinal edges extending the length of the plate and two end edges joining said longitudinal edges, the plates of each pair being sealably coupled together, wherein the planar portions are spaced apart thereby enclosing a longitudinal flow passageway extending therebetween and forming spaces between adjacent plate pairs defining lateral air passageways;

the plates each being provided with at least two apertures therethrough, said apertures being spaced apart in the longitudinal direction of the plate and spaced from the end edges of the plate, each aperture in one plate being substantially in registration with an aperture in said other plate in said plate pair;

the plates being formed with connecting portions peripherally encircling each aperture and extending transversely from the plates;

said plurality of plate pairs being stacked together in spaced apart relationship, wherein each connecting portion extending from a plate pair is connected to a connecting portion extending from an adjacent plate pair to form a sealable coupling, said connecting portions together enclosing substantially transverse flow passageways, said transverse flow passageways being spaced apart and in flow communication with the lateral flow passageways;

means defining an inlet port in flow communication with one of said transverse passageways, and means defining an outlet port in flow communication with another of said transverse passageways;

the transverse passageways having end portions and means for closing said end portions not in flow communication with the inlet and outlet ports; and fins located in said lateral air passageways, said fins being in thermal contact with the plates, and having transverse fluid passageways extending therethrough, wherein said connecting positions are tubes, said sealable coupling includes an overlapping portion which overlaps a portion of at least one of said tubes, the tubes of each upper plate project upwardly from the respective upper plate and the tubes of each lower plate project in the opposite transverse direction from the respective lower plate, said end edge of the plates are each provided with a flange member extending transversely from the planar portion thereof, said flange member provided with a curvilinear end portion adapted to overlap with a curvilinear end portion of a flange member of an adjacent plate pair, and outer end sections of said fins are located laterally adjacent said tubes or longitudinally outwardly from said tubes on the sides thereof located away from the longitudinal center of the adjacent plates, the lateral location of said outer end sections being in a direction perpendicular to the longitudinal edges of the plates.

* * * * *